US008415281B2

(12) United States Patent
Iwata

(10) Patent No.: US 8,415,281 B2
(45) **Date of Patent: *Apr. 9, 2013**

(54) SLIDING RESIN COMPOSITION

(75) Inventor: Hideki Iwata, Inuyama (JP)

(73) Assignee: Daido Metal Company Ltd., Nagoya (JP)

( * ) Notice: Subject to any disclaimer, the term of this patent is extended or adjusted under 35 U.S.C. 154(b) by 141 days.

This patent is subject to a terminal disclaimer.

(21) Appl. No.: 12/893,262

(22) Filed: Sep. 29, 2010

(65) Prior Publication Data

US 2011/0082059 A1 Apr. 7, 2011

(30) Foreign Application Priority Data

Oct. 6, 2009 (JP) ..... 2009-232084

(51) Int. Cl.
*C10M 111/04* (2006.01)
*C10M 169/04* (2006.01)
*C09G 3/00* (2006.01)

(52) U.S. Cl. ..... 508/131; 508/168; 508/590

(58) Field of Classification Search ..... 508/131, 508/168, 590

See application file for complete search history.

(56) References Cited

U.S. PATENT DOCUMENTS 4,847,135 A * 7/1989 Braus et al. ..... 428/138

FOREIGN PATENT DOCUMENTS

JP 2777724 B2 5/1998

* cited by examiner

*Primary Examiner* — Ellen McAvoy
*Assistant Examiner* — Vishal Vasisth
(74) *Attorney, Agent, or Firm* — Browdy and Neimark, P.L.L.C.

(57) ABSTRACT

A sliding resin composition is provided which rapidly forms a transfer adhesion film of PTFE on the surface of a counter member at the initial stage of sliding. That is, in the case of using resin composition 1 which is in such a state that particles of PTFE 3 having PTFE film forming agent 4 embedded are dispersed in synthetic resin 2, when the surface of particles of PTFE 3 on the sliding surface of resin composition 1 contacts with the surface of an associated shaft, the PTFE film forming agent 4 is also present at the contact portion, whereby transfer adhesion of PTFE 3 to the surface of the associated shaft is accelerated and thus the time required for decrease of coefficient of friction can be shortened.

5 Claims, 2 Drawing Sheets

SLIDING RESIN COMPOSITION

BACKGROUND OF THE INVENTION

The present invention relates to a sliding resin composition comprising a synthetic resin which contains PTFE as a solid lubricant and a PTFE film forming agent.

Hitherto, there have been used sliding resin compositions comprising various synthetic resins which contain polytetrafluoroethylene (hereinafter referred to as "PTFE") as a solid lubricant. As these sliding resin compositions, proposed are those which comprise various synthetic resins which further contain a phosphate in addition to PTFE. When sliding resin compositions containing PTFE and a phosphate are used, the phosphate promotes transfer adhesion of PTFE to the surface of a counter member during sliding to form a transfer adhesion film of PTFE on the surface of the counter member, resulting in improvement of sliding characteristics of resin sliding member under dry condition.

For example, Japanese Patent No. 2777724 (Patent Document 1) discloses use of calcium phosphate, magnesium phosphate, barium phosphate, or lithium phosphate as a PTFE film forming agent. However, recently, it is also known that inorganic compounds such as lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, calcium carbonate, strontium carbonate, barium carbonate, calcium sulfate, and barium sulfate also function as a PTFE film forming agent.

Patent Document 1: Japanese Patent No. 2777724

SUMMARY OF THE INVENTION

However, even when a resin composition comprising a synthetic resin in which PTFE and PTFE film forming agent are uniformly dispersed as in Patent Document 1 is used, during the initial period of starting of sliding and before formation of transfer adhesion film of PTFE on the surface of the counter member, coefficient of friction is high and stick slipping sometimes occur to cause generation of vibration or sliding noise in the apparatus which uses the sliding member. The present invention has been accomplished under these circumstances, and the object is to provide a sliding resin composition which forms a transfer adhesion film of PTFE rapidly on the surface of counter member at the initial stage of sliding to lower the coefficient of friction.

That is, in order to attain the above object, the present invention includes the following constituents.

(1) A sliding resin composition comprising a synthetic resin containing PTFE as a solid lubricant and a PTFE film forming agent wherein the PTFE is dispersed in the form of particles in the synthetic resin, and the PTFE film forming agent is embedded in the surface of particles of the PTFE.

(2) A sliding resin composition of (1) wherein the area ratio of the PTFE film forming agent on the surface of particles of the PTFE is in the range of 5-30%.

(3) A sliding resin composition of (1) or (2) wherein the average particle diameter of the PTFE film forming agent is not more than 1/3 of the average particle diameter of the PTFE.

(4) A sliding resin composition of (1), (2) or (3) in which the synthetic resin additionally contains one or more of molybdenum disulfide, tungsten disulfide and graphite as the solid lubricant.

Figure 1:
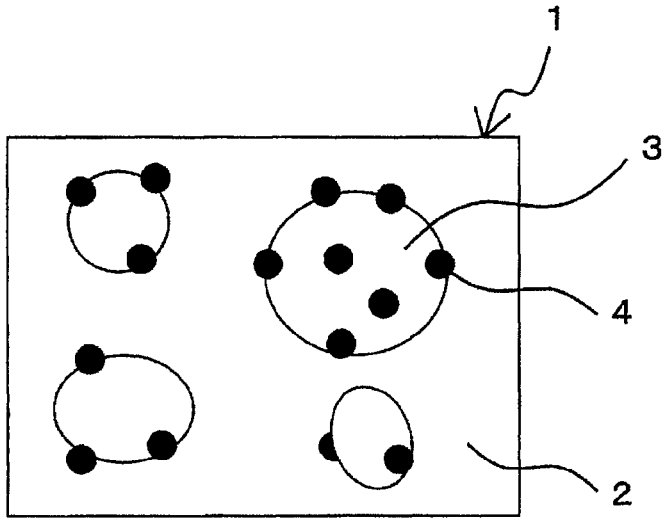
FIG. 1 is a schematic view showing the resin composition when the PTFE film forming agent is embedded in the surface of particles of the PTFE.

In the above drawings, reference numeral 1 indicates resin composition, 2 indicates synthetic resin, 3 indicates PTFE, and 4 indicates PTFE film forming agent.

DESCRIPTION OF EMBODIMENTS

In order to attain the above object, the sliding resin composition of the above (1) comprises a synthetic resin containing PTFE as a solid lubricant and a PTFE film forming agent wherein the PTFE is dispersed in the form of particles in the synthetic resin, and the PTFE film forming agent is embedded in the surface of particles of the PTFE.

The state of the PTFE film forming agent being embedded in the surface of particles of PTFE in the present invention is not limited to such a state that the whole of the particle of the PTFE film forming agent is completely embedded in the surface of particles PTFE, but includes such a state that only a part of the particle of the PTFE film forming agent is embedded in the surface of the particle of PTFE, namely, such a state that the particle of the PTFE film forming agent adheres to the surface of the particle of PTFE.

As the synthetic resins in the present invention, there may be used general synthetic resins such as polyimide, polyamidimide, polybenzimidazole, polyethylene, polypropylene, polyether ether ketone, polyphenylene sulfide, polyamide, polyacetal, etc. The kind of the synthetic resins has no direct relation with transfer adherence of PTFE to the surface of the counter member and hence optional synthetic resins can be used. However, particularly such synthetic resins as polyimide, polyamidimide and polybenzimidazole are high in heat resistance and strength, and these are suitable for sliding resin compositions used under high load conditions. Content of the PTFE and that of the PTFE film forming agent in the sliding resin composition are preferably 10-40 mass % and 5-15 mass %, respectively, and the contents can be adjusted depending on the sliding conditions and the kind of the PTFE film forming agent.

As the PTFE in the present invention, there may be suitably used molding powders obtained by suspension polymerization. When molding powders obtained by suspension polymerization are used, the particles of the PTFE film forming agent can be embedded by pressing them onto the surface of particles of PTFE by external force (mechanical force), and further the particles of PTFE are not deformed (to flaky form) by external force and the aspect ratio (length of longer diameter of PTFE particle/length of shorter diameter of PTFE particle) of PTFE in which the PTFE film forming agent is embedded can be less than 1.5. Therefore, particles of PTFE can easily be dispersed in the synthetic resin.

As the PTFE film forming agent in the present invention, there may be used at least one of inorganic compounds such as calcium phosphate, barium phosphate, magnesium phosphate, lithium phosphate, lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, calcium carbonate, strontium carbonate, barium carbonate, calcium sulfate, and barium sulfate.

Furthermore, the sliding resin composition of the present invention may be used for sliding members in which it is coated in the form of layers on the surface of a substrate of various metals, or sliding members in which a porous metal sintered layer is formed on the substrate of various metals and is impregnated with the sliding resin composition.

The sliding resin composition of the above (2) is characterized in that the area ratio of the PTFE film forming agent on the surface of particles of PTFE is in the range of 5-30% in the sliding resin composition of the above (1).

The sliding resin composition of the above (3) is characterized in that the average particle diameter of the PTFE film forming agent is not more than 1/3 of the average particle diameter of PTFE in the sliding resin composition of the above (1) or (2).

The sliding resin composition of the above (4) is characterized in that the synthetic resin in the sliding resin composition of the above (1), (2) or (3) additionally contains one or more of molybdenum disulfide, tungsten disulfide and graphite as the solid lubricant.

In the case of the sliding resin composition of the above (1), when the surface of particles of PTFE present on the sliding surface during sliding contacts with the surface of the counter member, the surface of particles of PTFE is sheared to produce shearing pieces (wear powders). If the shearing pieces of PTFE transfer to the surface of the counter member to form a film of PTFE, coefficient of friction decreases. In the present invention, since the PTFE film forming agent is in the state of being embedded in the surface of particles of PTFE, the PTFE film forming agent which promotes transfer adhesion of PTFE is also sheared simultaneously with shearing of PTFE, and thus, transfer adhesion film of PTFE can be rapidly formed on the surface of the counter member.

On the other hand, in the case of using a resin composition in which only particles of PTFE are dispersed as in the conventional method, PTFE hardly transfers and adheres to the surface of the counter member. Furthermore, in the case of using a resin composition comprising a binder resin comprising a synthetic resin in which particles of PTFE and PTFE film forming agent are uniformly dispersed as in the Patent Document 1, the probability that the PTFE film forming agent is present at the places on the surface of particles of PTFE where shearing pieces (wear powders) are generated is lower than in the present invention, and there is a high frequency of the shearing pieces on the surface of particles of PTFE and the PTFE film forming agent sheared from the surface of the synthetic resin being individually discharged out of the sliding surface without acting one another, and therefore a PTFE transfer adhesion film cannot be formed rapidly on the surface of the counter member.

As mentioned in the above (2), it is preferred that the area ratio of the PTFE film forming agent on the surface of particles of PTFE is in the range of 5-30%. If the area ratio of the PTFE film forming agent is less than 5%, the amount of the PTFE film forming agent is too small, and hence the effect to promote transfer adhesion of PTFE to the surface of the counter member cannot be sufficiently obtained. On the other hand, if the area ratio of the PTFE film forming agent exceeds 30%, the amount of PTFE is too small, and hence the effect to promote transfer adhesion of PTFE to the surface of the counter member cannot sufficiently be obtained.

In the case of the sliding resin composition of the present invention, the particles of the transfer film forming agent are previously embedded by pressing them onto the surface of the particles of PTFE by external force (mechanical force), and as mentioned in the above (3), it is preferred that the average particle diameter of the PTFE film forming agent is not more than 1/3 of the average particle diameter of the PTFE. The smaller the particle diameter of the PTFE film forming agent than the particle diameter of PTFE, the easier the attainment of the embedding of the PTFE film forming agent in the surface of particles of PTFE. On the other hand, if the ratio of the particle diameter exceeds 1/3, the PTFE film forming agent is unevenly present on the surface of particles of PTFE.

Furthermore, as mentioned in the above (4), sliding characteristics of the resin sliding member can be enhanced by additionally containing one or more of molybdenum disulfide, tungsten disulfide and graphite in the synthetic resin as the solid lubricant. Content of these solid lubricants may be adjusted depending on the sliding conditions under which the resin sliding member is used, and specifically, 1-60 mass % of the solid lubricant may be contained in the sliding resin composition.

Referring to FIG. 1, explanation will be made on resin composition 1 of an embodiment in which polyamidimide (hereinafter referred to as "PAI") is used as synthetic resin 2 and calcium phosphate is used as PTFE film forming agent 4 which is embedded in the surface of particles of PTFE 3. The PTFE 3 is a molding powder produced by suspension polymerization, and there may be used "TEFLON 7A-J (trademark)" and "TEFLON MP-1300 (trademark)" manufactured by Mitsui Du Pont Co., Ltd., "FLUON G 190 (trademark)" manufactured by Asahi Glass Co., Ltd., and the like. Further, as shown in FIG. 1, calcium phosphate which is PTFE film forming agent 4 is embedded in the surface of particles of PTFE 3, and the PTFE 3 is dispersed in the synthetic resin 2.

In this embodiment, calcium phosphate which is PTFE film forming agent 4 having an average particle diameter of 5 μm is previously embedded in the surface of particles of PTFE ("TEFLON 7A-J (trademark)" manufactured by Mitsui Du Pont Co., Ltd.) 3 having an average particle diameter of 30 μm by a general roll mill kneading machine. Specifically, when particles of PTFE 3 and PTFE film forming agent 4 pass between two rolls differing in revolving direction, particles of the PTFE film forming agent 4 are pressed onto the surface of particles of PTFE 3 by an external force (pressing force between the rolls and shearing force between roll surfaces) to embed the particles of the PTFE film forming agent 4.

The inventors have confirmed that particles of various PTFE film forming agents 4 can be embedded in the surface of the particles of PTFE 3 and furthermore particles of PTFE 3 can be prevented from becoming flaky only by combination of using molding powders produced by suspension polymerization as PTFE 3 and employing a mixing and kneading method of such a type as passing the sample between revolving rolls such as a roll mill kneading machine. The particles of PTFE 3 having on the surface the embedded PTFE film forming agent 4 which are obtained by the above combination have an aspect ratio of less than 1.5, and can be uniformly dispersed in the synthetic resin 2.

On the other hand, when as PTFE there is used a molding powder prepared by suspension polymerization ("TEFLON 7A-J (trademark)" manufactured by Mitsui Du Pont Co., Ltd.) having an average particle diameter of 30 μm) and simultaneously there is employed as other general mixing and kneading methods, a method of mixer type using a revolving agitation blade or a method of jet mill type of impinging sample powders against each other at a high speed, the PTFE film forming agent cannot be embedded in the surface of particles of PTFE. Furthermore, in the case of employing mixing and kneading methods of ball mill type, the PTFE film forming agent can be embedded in the surface of the particles of PTFE, but the particles of PTFE bind with each other and coarsely granulated, and it is difficult to disperse them in the synthetic resin at a later step.

Furthermore, when a fine powder prepared by emulsion polymerization ("MP1500-J (trademark)" manufactured by Mitsui Du Pont Co., Ltd.) having an average particle diameter of 20 μm) is used as PTFE, and a mixing and kneading method of such a type as passing the sample between revolving rolls such as roll mill kneading machine is employed, the surface of particles of PTFE is soft, and the PTFE film forming agent can be easily embedded, but PTFE is apt to be fiberized by the external force of mixing and kneading, resulting in formation of flaky particles of PTFE. In the case of resin composition in which flaky particles of PTFE are dispersed in the synthetic resin, when a sliding member is made by coating the resin composition on a metallic substrate, the flaky particles of PTFE are arranged in parallel to the coating surface (sliding surface), and thus strength of the sliding member is conspicuously deteriorated. Moreover, when a porous metal sintered layer is formed on the surface of the metallic substrate, and the porous metal sintered layer is impregnated with the resin composition, the flaky particles of PTFE hardly penetrate into the porous metal sintered layer, and it is difficult to impregnate and coat the resin composition.

Moreover, when a heat treated and baked PTFE ("KT-400M (trademark) manufactured by Kitamura Co., Ltd. having an average particle diameter of 33 μm) is used as the particles of PTFE, the surface of particles of PTFE is hard, and the PTFE film forming agent can hardly be embedded.

As mentioned above, a resin sliding member can be obtained by diluting particles of PTFE 3 in which PTFE film forming agent 4 is previously embedded and PAI with an organic solvent, coating the resulting resin composition 1 in the state of coating composition on the surface of a metallic substrate, then heating the solvent for drying and heating the resin composition 1 for baking. In this embodiment, there is shown a method of previously embedding the PTFE film forming agent 4 in the surface of particles of PTFE 3, but the present invention is not limited to this method. For example, embedding of the PTFE film forming agent 4 in the surface of particles of PTFE 3 and mixing of synthetic resin 2 with the particles of PTFE 3 may be simultaneously carried out by processing with a roll mixing and kneading machine the coating composition prepared by diluting the synthetic resin 2, the PTFE 3 and the PTFE film forming agent 4 with an organic solvent.

It is preferred that the particles of PTFE 3 in which PTFE film forming agent 4 is embedded have an area ratio of the PTFE film forming agent 4 on the surface of particles of PTFE 3 in the range of not less than 5% and not more than 30%. If the area ratio of the PTFE film forming agent 4 is less than 5%, the amount of the PTFE film forming agent 4 is too small, and hence the effect to promote transfer adhesion of PTFE 3 to the surface of the counter member cannot be sufficiently obtained. On the other hand, if the area ratio of the PTFE film forming agent 4 exceeds 30%, the amount of PTFE 3 is too small, and hence the effect to promote transfer adhesion of PTFE 3 to the surface of the counter member cannot be sufficiently obtained.

In the sliding resin composition 1, the whole of the PTFE film forming agent 4 contained is not needed to be embedded in the surface of PTFE 3, and a part of the PTFE film forming agent 4 may be separately dispersed in the synthetic resin 2. Moreover, in the sliding resin composition 1, it is most preferred that the PTFE film forming agent 4 is embedded in the surface of all the particles of PTFE 3, and this state can be obtained by prolonging the time for mixing and kneading the particles of PTFE 3 and the PTFE film forming agent 4, but it causes deterioration of productivity. When the productivity is to be enhanced by shortening the time for mixing and kneading of the particles of PTFE 3 and the PTFE film forming agent 4, the PTFE film forming agent 4 may not be embedded in the surface of a part of the particles of PTFE 3. Specifically, the inventors have confirmed that if the PTFE film forming agent 4 is embedded in the particles of at least 50% of PTFE 3 contained in the resin composition 1, there is obtained the effect of promoting the transfer adhesion of PTFE 3 to the surface of the counter member.

It is preferred that the average particle diameter of the PTFE film forming agent is not more than 1/3 of the average particle diameter of the PTFE. The smaller the particle diameter of the PTFE film forming agent 4 than the particle diameter of PTFE 3, the easier the attainment of the embedding of the PTFE film forming agent 4 in the particles of PTFE 3. On the other hand, if the ratio of the particle diameter exceeds 1/3, the PTFE film forming agent 4 is unevenly present on the surface of particles of PTFE 3.

As the synthetic resin 2, general synthetic resins such as polyimide, polyamidimide, polybenzimidazole, polyethylene, polypropylene, polyether ether ketone, polyphenylene sulfide, polyamide, polyacetal, etc. can be used. The kind of the synthetic resin 2 has no direct relation with transfer adhesiveness of PTFE 3 to the surface of the counter member, and hence optional synthetic resins 2 can be used. However, particularly, synthetic resins 2 such as polyimide, polyamidimide and polybenzimidazole are high in heat resistance and strength and these are suitable for sliding resin composition 1 used under high loading conditions. Content of PTFE 3 and that of PTFE film forming agent 4 in the sliding resin composition 1 are preferably 10-40 mass % and 5-15 mass %, respectively, and the contents can be adjusted depending on the sliding conditions or the kind of the PTFE film forming agent 4.

The PTFE film forming agent 4 is not limited to calcium phosphate shown in this embodiment, and there can be used at least one of the inorganic compounds such as barium phosphate, magnesium phosphate, lithium phosphate, lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, calcium carbonate, strontium carbonate, barium carbonate, calcium sulfate, barium sulfate, etc. The functional mechanism of these inorganic compounds has not yet been clarified, but it is known that when they are contained in resin composition 1 together with PTFE 3, they have a function to promote transfer adhesion of PTFE 3 to the surface of the counter member during sliding. Moreover, the inventors have confirmed that like the calcium phosphate shown in this embodiment, these PTFE film forming agents 4 can also be embedded in the surface of particles of PTFE 3 which is a molding powder prepared by suspension polymerization with using a roll mixing and kneading machine.

Furthermore, the sliding resin composition 1 may additionally contain one or more of molybdenum disulfide, tungsten disulfide and graphite as the solid lubricant. The sliding characteristics of the resin composition 1 can be enhanced by dispersing particles of these solid lubricants in synthetic resin 2. The content of the solid lubricant may be adjusted depending on the sliding conditions under which the resin composition 1 is used, and specifically, it may be contained in an amount of 1-60 mass % in the sliding resin composition 1.

Next, sliding tests were conducted in Examples 1 and 2, and Comparative Example 1 using the resin composition 1 of this embodiment. The compositions of resin composition 1 in Examples 1 and 2, and Comparative Example 1 are shown in Table 1. In Examples 1 and 2, and Comparative Example 1, PAI was used as synthetic resin 2, a molding powder having an average particle diameter of 30 μm prepared by suspension polymerization was used as PTFE 3, and calcium phosphate having an average particle diameter of 5 μm was used as PTFE film forming agent 4. Molybdenum disulfide was used as the solid lubricant in Example 2.

TABLE 1

| | Composition (mass %) | Time for decrease in coefficient of friction |
|---|---|---|
| Example 1 | PAI + 30% PTFE + 10% calcium phosphate | 7 minutes |
| Example 2 | PAI + 30% PTFE + 10% calcium phosphate + 5% molybdenum disulfide | 8 minutes |
| Comparative Example 1 | PAI + 30% PTFE + 10% calcium phosphate | 20 minutes |

In Examples 1 and 2, particles of calcium phosphate were previously embedded in the surface of all particles of PTFE 3 by a roll kneading machine in such a manner that the area ratio of calcium phosphate in the surface of particles of PTFE 3 was 25% on the average. The area ratio of calcium phosphate which was PTFE film forming agent 4 on the surface of particles of PTFE 3 can be measured in the following manner. That is, an image of the composition at 2000× magnification was photographed by an EPMA apparatus and the ratio of areas of PTFE 3 and calcium phosphate was calculated by processing the photographed image using a general image analyzing system.

Furthermore, in Examples 1 and 2, the resin composition 1 having the composition as shown in Table 1 was diluted with an organic solvent and mixed by a general revolution mixing machine (mixer type) to prepare a coating composition. This was coated on the surface of a metallic substrate, followed by subjecting the organic solvent to heating for drying and the resin composition 1 to heating for baking. A metallic substrate comprising a steel backing metal layer and a porous metal layer which was previously prepared was used as the metallic substrate, and the porous metal layer was impregnated and coated with the resin composition 1. The substrate was made into cylindrical form with the resin composition 1 being on the inner diameter side to obtain a sample for sliding test.

In Comparative Example 1, the composition of the sample was the same as in Example 1, and synthetic resin 2, PTFE 3 and PTFE film forming agent 4 were also the same as those used in Example 1. The Comparative Example 1 was different from Example 1 in that calcium phosphate was not embedded in the surface of particles of PTFE 3. That is, in Comparative Example 1, without previously embedding particles of calcium phosphate in the particles of PTFE 3, the resin composition 1 having the composition as shown in Table 1 was diluted with an organic solvent and made into the state of coating composition by mixing with a general revolution mixing machine (mixer type). The form of the sample for sliding test and method for making the sample were the same as in Examples 1 and 2.

Test conditions of the sliding test are shown in Table 2. Just after starting of the sliding test, coefficient of friction between the resin composition 1 and the associated shaft was great, but decreased with lapse of time and finally reached an equilibrium state where the coefficient of friction did not change. Therefore, the sliding test was evaluated by the time from starting of the test until the coefficient of friction decreased and the change of coefficient of friction reached the equilibrium state. The results are shown in Table 2 and FIG. 3.

TABLE 2

| | |
|---|---|
| Tester | Journal bearing test machine |
| Load | 5 MPa |
| Sliding speed | 6 m/min |
| Associated shaft | S55C |
| Roughness of associated shaft | 1 Rz |
| Lubrication condition | Dry condition |

Figure 3:
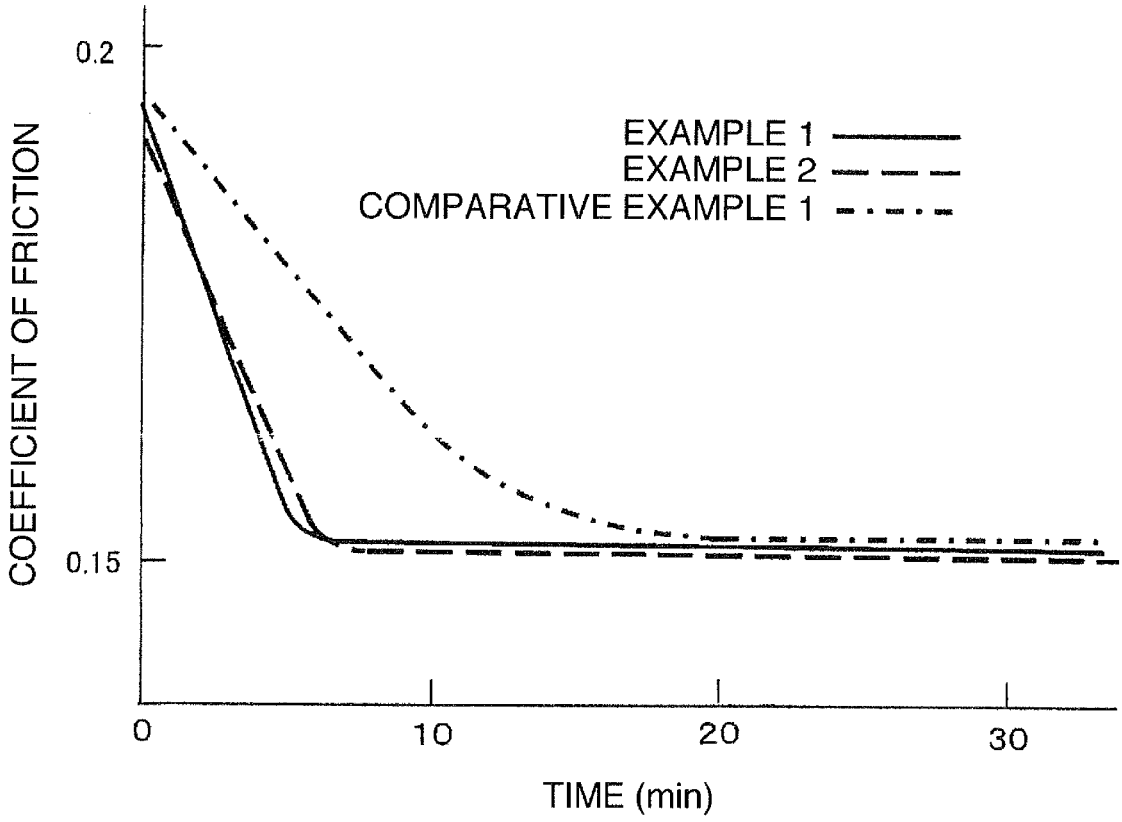
FIG. 3 is a graph showing the results of sliding tests conducted using the resin composition of the present invention.

As shown in FIG. 3, in both the Example 1 and Comparative Example 1, the coefficients of friction just after starting of the sliding test were nearly the same. This is because PTFE 3 did not transfer and adhere to the surface of the associated shaft just after starting of the sliding test in both the Example 1 and Comparative Example 1.

In Example 1 and Comparative Example 1, since PTFE 3 began to transfer and adhere to the surface of the associated shaft with lapse of time, the coefficient of friction decreased and change of the coefficient of friction reached equilibrium state when a transfer adhesion film of PTFE 3 was sufficiently formed on the surface of the associated shaft. The composition of the resin composition 1 was the same in Example 1 and Comparative Example 1, and therefore the coefficient of friction was nearly the same not only just after starting of sliding test, but also after the change of the coefficient of friction reaching equilibrium state. However, the time required for the change of the coefficient of friction reaching equilibrium state was 20 minutes in Comparative Example 1 while it was shorter, namely, 7 minutes in Example 1. This is because resin composition 1 of Example 1 was in such a state that particles of PTFE 3 on the surface of which calcium phosphate (PTFE film forming agent 4) were embedded were in the state of being dispersed in PAI (synthetic resin 2) as shown in FIG. 1, and when the surface of particles of PTFE 3 on the sliding surface of resin composition 1 contacted with the surface of the associated shaft, the PTFE film forming agent 4 was also present at the contact portion, whereby transfer and adhesion of PTFE 3 to the surface of the associated shaft was accelerated and thus the time required for decrease of coefficient of friction could be shortened.

Figure 2:
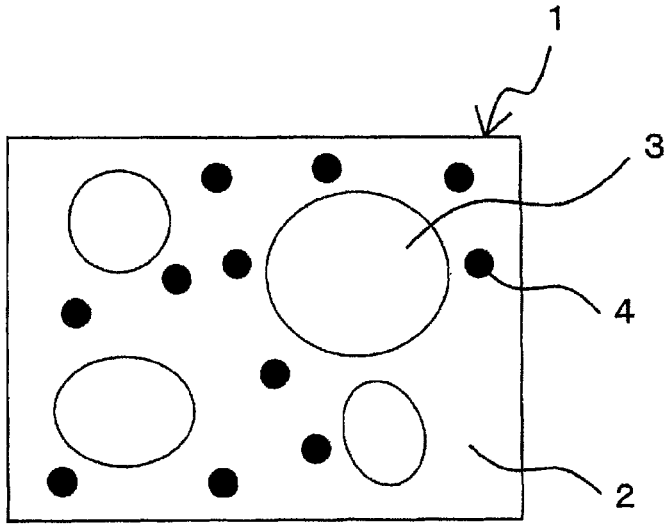
FIG. 2 is a schematic view showing the resin composition when the PTFE film forming agent is not embedded in the surface of particles of the PTFE.

On the other hand, the resin composition 1 of Comparative Example 1 was in such a state that particles of PTFE 3 and calcium phosphate (PTFE film forming agent 4) were separately dispersed in polyamidimide (synthetic resin 2) as shown in FIG. 2, and when the surface of particles of PTFE 3 on the sliding surface of the resin composition 1 contacted with the surface of the associated shaft, the probability of PTFE film forming agent 4 being simultaneously present at the contact portion was lower than in Example 1. Therefore, many of them did not act with each other and were discharged out of the sliding surface as shearing pieces (wearing powders). Thus, transfer and adhesion of PTFE 3 to the surface of the associated shaft hardly occurred, and a long time was required for decrease of the coefficient of friction.

The resin composition 1 of Example 2 contained additionally molybdenum disulfide as a solid lubricant in the composition of Example 1. As shown in FIG. 3, even when the solid lubricant was contained, there was the effect to accelerate transfer and adhesion of PTFE 3 to the surface of the associated shaft to shorten the time for decrease of coefficient of friction as in Example 1.

In these embodiments, the effects were shown by evaluation of sliding tests using the resin composition 1 having the composition shown in Table 1, but the composition of the resin composition 1 of the present invention is not limited to that of Table 1. That is, the composition of resin composition 1 can be adjusted depending on circumstances of using the sliding part of resin composition member and sliding conditions of sliding members. The inventors have confirmed that if the composition of resin composition 1 is the same, when the content of particles of PTFE 3 is 10-40 mass % and that of PTFE film forming agent 4 is 5-15 mass % in the resin composition 1, and when the PTFE film forming agent 4 is embedded in the surface of particles of PTFE 3, transfer adhesion of PTFE 3 to the surface of the associated shaft is accelerated and the time for decrease of coefficient of friction is shortened as compared with when PTFE film forming agent 4 is not embedded in the surface of particles of PTFE 3. Furthermore, the inventors have confirmed that the synthetic resin 2 constituting the resin composition 1 is not limited to PAI used in this embodiment, and the effect of the present invention can also be obtained when other kind of synthetic resin 2 is used.

The invention claimed is:

1. A sliding resin composition comprising a synthetic resin containing PTFE as a solid lubricant and a particulate PTFE film forming agent wherein the PTFE is dispersed in the form of particles in the synthetic resin, the PTFE film forming agent is embedded in the surface of particles of the PTFE particles, the PTFE film forming agent has an area ratio on the surface of particles of the PTFE in the range of 5-30%, the PTFE is contained in an amount of 10-40 mass % based on the sliding resin composition, the PTFE film forming agent is contained in an amount of 5-15 mass % based on the sliding resin composition, and the PTFE film forming agent is at least one of inorganic compounds selected from the group consisting of calcium phosphate, barium phosphate, magnesium phosphate, lithium phosphate, lithium tertiary phosphate, calcium tertiary phosphate, calcium hydrogenphosphate or anhydride thereof, magnesium hydrogenphosphate or anhydride thereof, lithium pyrophosphate, calcium pyrophosphate, magnesium pyrophosphate, lithium metaphosphate, calcium metaphosphate, magnesium metaphosphate, lithium carbonate, magnesium carbonate, calcium carbonate, strontium carbonate, barium carbonate, calcium sulfate, and barium sulfate.

2. A sliding resin composition according to claim 1, wherein the average particle diameter of the PTFE film forming agent is not more than 1/3 of the average particle diameter of the PTFE.

3. A sliding resin composition according to claim 1, wherein the synthetic resin additionally contains at least one of molybdenum disulfide, tungsten disulfide and graphite as the solid lubricant.

4. A sliding resin composition according to claim 2, wherein the synthetic resin additionally contains at least one of molybdenum disulfide, tungsten disulfide and graphite as the solid lubricant.

5. A sliding resin composition according to claim 1, wherein the synthetic resin is at least one resin selected from the group consisting of polyimide, polyamidimide, polybenzimidazole, polyethylene, polypropylene, polyether ether ketone, polyphenylene sulfide, polyamide and polyacetal.

* * * * *